United States Patent [19]

Neidiffer et al.

[11] Patent Number: 4,940,493

[45] Date of Patent: Jul. 10, 1990

[54] ALUMINUM CLEANING COMPOSITION AND PROCESS

[76] Inventors: Fred Neidiffer, P.O. Box 1650, Rancho Mirage, Calif. 92270; Charles E. Fox; Patsy E. Fox, both of Rte. #1, Box 87, Durant, Iowa 52747

[21] Appl. No.: 251,299

[22] Filed: Sep. 30, 1988

[51] Int. Cl.[5] ..... C23G 1/02

[52] U.S. Cl. ..... 134/3; 134/41; 29/DIG. 7

[58] Field of Search ..... 134/3, 40, 41, 2; 252/136, 142; 29/DIG. 7

[56] References Cited

U.S. PATENT DOCUMENTS

| | | | |
|---|---|---|---|
| 3,211,659 | 10/1965 | Pikaar et al. | 252/136 |
| 3,306,773 | 2/1967 | Laporte et al. | 134/2 |
| 3,448,055 | 6/1969 | Mickelson et al. | 252/79.3 |
| 3,527,609 | 9/1970 | Vinso et al. | 134/3 |
| 4,049,467 | 9/1977 | Rubin | 134/2 |
| 4,129,423 | 12/1978 | Rubin | 51/304 |
| 4,264,418 | 4/1981 | Wood et al. | 204/129.95 |
| 4,370,173 | 1/1983 | Dollman | 134/3 |
| 4,599,116 | 7/1986 | King et al. | 134/2 |
| 4,713,119 | 12/1987 | Earhart et al. | 134/3 |
| 4,728,456 | 3/1988 | Yamasoe et al. | 134/3 |
| 4,806,259 | 2/1989 | Amjad | 252/142 |

*Primary Examiner*—Patrick P. Garvin
*Assistant Examiner*—George R. Fourson
*Attorney, Agent, or Firm*—Gordon L. Peterson; Frank J. Uxa, Jr.

[57] ABSTRACT

A composition and process for cleaning an aluminum-containing article is disclosed. The process comprises: contacting a debris-laden aluminum containing article with a composition at conditions effective to do at least one of the following: (1) remove at least a portion of the debris from the aluminum-containing article and (2) condition at least a portion of the debris for removal from the aluminum-containing article, the composition comprising water, at least one tartaric component selected from the group consisting of racemic tartaric acid, salts of racemic tartaric acid and mixtures thereof, at least one acidic component in an amount effective to increase the solubility of the tartaric component in the composition, and at least on surface active component; and recovering the aluminum-containing article having at least a portion of the debris removed therefrom.

21 Claims, No Drawings

ALUMINUM CLEANING COMPOSITION AND PROCESS

BACKGROUND OF THE INVENTION

This invention relates to a composition and process useful for cleaning aluminum-containing articles. More particularly, the invention relates to a composition and process for removing debris, e.g., smut, unwanted deposit material, soil and the like, from such articles, e.g., aluminum foodstuff or beverage containers or cans.

Aluminum-containing articles are often formed into shapes using lubricants to assist in the forming process. For example, one or more lubricants are often employed in the drawing and ironing of aluminum container bodies of the type used to package foodstuffs and beverages. The forming processing itself and/or the lubricant or lubricants employed produce debris, e.g., as noted above, on the article which interferes with the over-all appearance of the article. In certain instances, this debris is referred to as smut. In general, such smut or smut-like material includes aluminum and/or alumina fines and/or lubricant material and/or lubricant residue. Such debris should be removed to provide an aluminum-containing article which is visually pleasing and, more importantly, make the article suitable for use, e.g., as a foodstuff or beverage container.

Various compositions have been suggested for use in cleaning aluminum articles. For example, King, et al U.S. Pat. No. 4,599,116 discloses an aqueous alkaline (a pH of at least 10) cleaning composition containing an alkalinity agent present in an amount to achieve removal of aluminum fines, a complexing agent, and one or more surfactants. Preferred alkalinity agents include alkali metal hydroxides and alkali metal carbonates. Among the complexing agents are gluconic acid, citric acid, glucoheptonic acid, sodium triphosphate, EDTA, tartaric acid or the like, as well as the soluble and compatible salts thereof and mixtures thereof. The relatively strong alkalinity agents employed could harm, e.g., etch, the aluminum surface unless care was exercised to control the cleaning operation.

Dollman U.S. Pat. No. 4,370,173 discloses removing lubricating oils and aluminum fines from aluminum surfaces using an aqueous solution of sulfuric and hydrofluoric acids and an anionic surfactant. Michelson, et al U.S. Pat. No. 3,448,055 discloses removing smut from aluminum with an aqueous composition including nitric acid, sulfuric acid, hydrofluoric acid, phosphoric acid and a surfactant. Such solutions of strong acids are effective to clean the aluminum surfaces, but also tend to etch the surface as well. Such etching is undesirable.

Earhart U.S. Pat. No. 4,713,119 discloses removing alkali metal aluminum silicate deposits from chemical processing equipment by alternating treatments with acidic and basic solutions. The acidic solution contains sulfuric acid, sodium bisulfate, tartaric acid or phosphoric acid. This patent does not disclose cleaning aluminum-containing surfaces nor that the acidic solution includes a surfactant.

Wood, et al U.S. Pat. No. 4,264,418 discloses removing oxide film from metals or alloys containing iron, nickel, copper, beryllium, chromium, gold, zinc, lead, or tin with a composition containing gluconic acid or its alkali metal salts, citric acid or its alkali metal salts, or tartaric acid or its alkali metal salts and, preferably, a non-ionic surfactant. Aluminum-containing articles are not disclosed. Further, no "strong" acid is included in the composition.

LaPorte, et al U.S. Pat. No. 3,306,773 discloses treating sintered aluminum parts with an aqueous alkaline solution before putting such parts into heat transfer surface. Pikaar U.S. Pat. No. 3,211,659 discloses acids, such as acetic acid, EDTA, citric acid, tartaric acid, gluconic acid, glyceric acid, malic acid, glycolic acid, saccharic acid, phosphoric acid, and benzoic acid for cleaning egg shells. Vinso U.S. Pat. No. 3,527,609 discloses the use of tartaric acid salts among salts of many polycarboxcylic acids for use in cleaning cooling water systems. Rubin U.S. Pat. Nos. 4,049,467 and 4,129,423 disclose removing manganese derived discolorations from hard surfaces by use of either dihydroxy maleic acid, dihydroxy tartaric acid, their alkali metal salts, or mixtures thereof. None of these references is concerned with relatively heavy duty cleaning of, e.g, smut removal from, aluminum surfaces.

SUMMARY OF THE INVENTION

A new composition and process for cleaning debris, in particular smut, from the surface of an aluminum-containing article had been discovered. This invention provides very effective and efficient cleaning, e.g., removal of debris, with little or no substantial adverse effect on, e.g., etching of, the surface being cleaned Thus, although the present composition includes at least one relatively strong acid, e.g., sulfuric acid, such acid often acts as a solubilizing agent rather than as the primary cleaning agent in removing debris from the aluminum-containing surface. In short, the present composition is specifically designed to clean, and not to etch, aluminum-containing surfaces.

In one broad aspect, the present invention involves a process for cleaning debris from the surface of an aluminum-containing article. This process comprises contacting a debris-laden aluminum-containing article with a composition comprising water, racemic tartaric acid and/or at least one salt thereof, at least one acidic component in an amount effective to increase the water solubility of the racemic tartaric acid and/or salt thereof, and at least one surface active component, i.e., surfactant; and recovering the aluminum-containing article having at least a portion of the debris removed therefrom. The contacting occurs at conditions effective to do at least one of the following: remove at least a portion of the debris from the aluminum-containing article and condition at least a portion of the debris for removal from the aluminum-containing article. The use of racemic tartaric acid and/or salts thereof has been found to provide effective aluminum cleaning without substantial adverse effects on, e.g., etching of, the surface being cleaned. This is particularly surprising since the inclusion of levo tartaric acid into the present compositions appears to have no substantial beneficial effect.

DETAILED DESCRIPTION OF THE INVENTION

The present compositions comprise water, racemic tartaric acid and/or salts thereof, at least one additional acidic component, and at least one surface active component. The water often, and preferably, acts as a carrier for the other components of the composition. Water preferably comprises a major amount, i.e., at least about 50%, by volume, and more preferably at least about 70% by volume, of the composition used to treat the aluminum-containing article. In certain instances, it is desirable to prepare the present compositions in the form of one or more concentrates, with reduced amounts of water. The use of such concentrate or concentrates reduces the cost of transporting the present composition to the cleaning site. Thus, the present compositions can be formulated at the cleaning site simply by combining the desired amounts of concentrate or concentrates and water.

In a particularly useful embodiment, two concentrates are prepared. One concentrate includes the racemic tartaric acid and/or salts thereof and the additional acidic component in water, while the other concentrate includes one or more surfactants. This is particularly useful in situations where it is difficult or impossible to include all the presently useful components in one concentrate which is substantially homogeneous, e.g., clear. For example, if the surfactant mixture includes a substantially hydrocarbonaceous component, e.g., a mineral oil component, such component has only limited water solubility and does not form a homogenous concentrate with the other components of the present composition. In this instance, the surfactant mixture is best employed as a separate concentrate which is combined with the other components at the cleaning site when the full amount of water is present.

The tartaric component, i.e., racemic tartaric acid and/or salts thereof, useful in the present invention provide substantial advantages. Without wishing to limit the scope of the invention to any particular theory of operation, it is believed that this component plays a substantial role or roles in removing debris from the aluminum-containing article. For example, in many instances the debris to be removed includes organic material, such as residues from lubricants, e.g., containing fatty acids, used in forming or shaping the aluminum-containing article. It is believed that the racemic tartaric acid and/or salts thereof are particularly effective in attacking this organic material, especially to reduce the ability of such organic material to adhere or cling to the aluminum-containing surface. By compromising this organic material, this tartaric and/or salt component is also believed to act to facilitate removing alumina particles (which are often a part of the debris) from the surface. While the racemic tartaric acid component provides effective debris cleaning/conditioning action, this component is insufficiently strong or aggressive to attack the aluminum-containing surface itself. Thus, the debris is removed and the aluminum-containing surface remains substantially unaffected, e.g., unetched.

Another feature of this invention is the discovery that the levo form of tartaric acid in the present compositions provides little or no added cleaning or other benefits. This is particularly unexpected and surprising since a number of the prior art patents, discussed previously, which disclosed tartaric acid and salts did not suggest any distinction between the racemic and levo forms.

Any suitable source of racemic tartaric acid and/or salts thereof may be employed. If a salt is used, it is preferred that the salt be an ammonium salt, an alkali metal salt, an alkaline earth metal salt or mixtures thereof, more preferably an alkali metal salt. A particularly useful source of the tartaric component is cream of tartar or potassium hydrogen tartrate. The tartaric component is preferably present in the composition in an amount in the range of about 0.1% to about 20%, more preferably about 2% to about 15%, by weight, calculated as tartaric acid.

Racemic tartaric acid and/or salts thereof often have relatively limited water solubility. Thus, the presently useful additional acidic component is present in an amount effective to increase the water solubility of such tartaric component. Such additional acidic component preferably is stronger, i.e., has a larger disassociation constant, than racemic tartaric acid. Examples of suitable acidic components include sulfuric acid, phosphoric acid, hydrochloric acid, hydrofluoric acid, nitric acid, mixtures thereof and the like, with sulfuric acid, phosphoric acid and mixtures thereof being preferred, in particular sulfuric acid.

Care should be exercised to avoid having excessive amounts of such additional acidic components present. Such excessive amounts of acidic components may interact with the aluminum-containing article and cause damage, e.g., etching, of the surface being cleaned. However, it should be noted that in a particularly useful embodiment of the present invention, the acidic component is present in an amount effective to solubilize aluminum fines which may be part of the debris to be removed from the aluminum-containing article. The amount of acidic component included in the present composition may vary over a wide range and depend on many factors, for example, on the particular acid or acids being employed, on the particular debris to be removed, on the chemical make-up of the present composition and on the particular cleaning application involved. In certain embodiments it is preferred to include sufficient acidic component to maintain a pH in the range of about 0.5 to about 3, more preferably about 0.8 to about 2, during the contacting step.

The present compositions include at least one surface active component or surfactant. In general, such surface active component or components act to increase or enhance the effectiveness of the composition, e.g., as an aluminum cleaner. However, it is not all together clear how such component or components function in the present invention. Without wishing to limit the invention to any particular theory of operation, it is believed that the surface active component or components act to do at least one of the following: (1) assist in removing the organic portion of the debris from the surface of the aluminum-containing article; (2) aid in maintaining the homogeneity of the composition during use; and (3) aid in preventing or inhibiting redeposition of the removed debris onto the surface of the aluminum-containing article.

Any suitable surface active component or combination of such components may be employed in the present compositions. Such component is preferably nonionic or anionic, with anionic surfactants being particularly preferred. The surface active component preferably has a Hydrophile-Lipophile Balance (HLB ratio), i.e., the balance of the size and strength of the hydrophilic (water-loving or polar) and lipophilic (oil-loving or non-polar) groups of the molecules, of at least about 12, more preferably in the range of about 12 to about 15. For further information regarding the determination of the HLB number of surfactants and emulsifying agents, reference is made to a publication entitled "The Atlas HLB System", Third Edition, 1963, by Atlas Chemical Industries, Inc.

Surfactants suitable for use in the practice of the present invention include, for example, those having hydrophobic groups comprising alkyl phenols, linear alcohols, branched-chain alcohols, secondary alcohols, propylene oxide/propylene glycol condensates and the like; hydrophilic groups such as ethylene oxide, ethylene oxide/ethylene glycol condensates and the like, and may further contain capping groups such as propylene oxide, chloride, benzyl chloride, amines and the like.

Specific examples of useful surfactants include free acids of complex organic phosphate esters (e.g., Gafac RP-170 from GAF Corporation); block polymers of propylene oxide and ethylene oxide (e.g., Pluonic L-61 from BASF Wyandotte, Inc.); ethoxylates of secondary alcohols containing about 11 to about 15 carbon atoms per molecule (e.g., Tergital 15-S-3 from Union Carbide Corporation); blends of linear alkyl sulfates and ethoxylates of secondary alcohols (as noted above); blends of anionic surfactants including ammonium lauryl sulfate, lauramide diethanol amine, sodium lauryl sarcosinate, and propyl ethyl diammonium ethosulfate; sodium linear alkyl sulfonate (e.g., Darvan No. 1 from R. T. Vanderbilt Company, Inc.); and the like. A particularly useful component, especially in combination with one or more other surface active components, comprises a mixture of one or more surfactants, especially anionic surfactants, such as dodecyl benzene sulfonic acid, together with at least one substantially hydrocarbonaceous material, such as paraffinic mineral oil. This mixture may also include water. The substantially hydrocarbonaceous material is believed to be particularly effective in removing organic debris from the aluminum-containing article. A specific example of such particularly useful component is Wax Emulsion M from Northwest Chemical Co.

The surfactant or combination of surfactants can be employed in the present compositions in concentrations which are effective to provide enhanced cleaning, i.e, relative to cleaning with a composition having no such surfactant or surfactants. Preferably, the surfactant or combination of surfactants are employed at concentrations in the range of about 0.01% to about 2%, more preferably about 0.05% to about 1%, by weight of the composition.

One or more coupling agents, e.g., conventional coupling agents such as butyl cellosolve, isopropyl alcohol and the like, may be included in the present compositions to provide increased homogeneity to the present composition (or to the concentrate from which the present composition is derived).

It is further contemplated that an antifoaming agent can be incorporated in the composition to avoid objectionable foaming. Any one of a variety of commercially available antifoaming agents can be employed for this purpose.

In accordance with the present invention, the present composition is applied to the debris-laden aluminum-containing article at comparatively low to moderate temperatures. Preferred composition/aluminum-containing article contacting temperatures are in the range of about 60° F. to about 150° F. with lower temperatures, e.g., about 60° F. to about 110° F. being particularly useful to provide effective cleaning while having no substantial adverse impact on, e.g., etching of, the aluminum-containing article. The contacting of the aluminum-containing articles to be cleaned can be effected by flooding, immersing, dipping, spraying and the like.

The aluminum-containing article may be subjected to a rinse step, e.g., with liquid water, to obtain removal, or more complete removal, of the debris. This rinse can be effected by flooding, immersing, dipping, spraying and the like of the article with or in the rinse material, e.g., at the temperatures noted above. In any event, after contact with the present composition, and the rinse step if desired or necessary, the aluminum-containing article is recovered and has a reduced amount, i.e., relative to the original debris-laden article, of debris on its surface.

The following non-limiting examples illustrate certain aspects of the present invention.

EXAMPLE 1

The following composition was prepared by blending together the various components with stirring:

| | Wt % |
|---|---|
| Water | 92.5 |
| Sulfuric Acid (25% by weight in water) | 0.7 |
| Cream of Tartar (potassium bitartrate)(1) | 6.5 |
| Surfactant I(2) | 0.07 |
| Surfactant II(3) | 0.07 |
| Surfactant III(4) | 0.03 |
| Surfactant IV(5) | 0.13 |
| | 100.00 |

(1)This material includes tartaric acid functionality in the racemic form.
(2)A commercially available anionic material including a free acid of a complex organic phosphate ester.
(3)A commercially available nonionic material including block copolymers of propylene oxide and ethylene oxide.
(5)A commercially available nonionic material including ethoxylates of secondary alcohols containing about 11 to about 15 carbon atoms per molecule.
(5)A commercially available blend of anionic and nonionic surfactants, believed to be linear alkyl sulfates together with ethoxylates of secondary alcohols as noted in (4) above.

This composition was tested as an aluminum cleaner by immersing a formed aluminum beverage can in the composition for about 15 minutes, at ambient temperature, i.e., about 70° F. to about 75° F., unless otherwise noted. This formed aluminum beverage can was contaminated by smut, a mixture including aluminum and alumina fines and fatty acid residues from the lubricant used in forming the can. This immersion or washing step was followed by a rinsing step in which the can was removed from the composition and placed in a bath of water, for about 15 minutes at ambient temperatures and then removed. Visual observation was used to determine the effectiveness of the composition as an aluminum cleaner.

The above-noted composition provided some smut removal during the washing step. Substantially all of the remaining smut was removed during the rinsing step so that a clean aluminum beverage can resulted. Moreover, except for smut removal, the can was substantially unaffected by the treatment. For example, no evidence of aluminum etching was observed. Such etching is undesirable and has often occurred in the past with cleaning compositions including relatively large concentrations of strong acids, such as sulfuric acid, hydrofluoric acid and the like.

EXAMPLE 2

Example 1 was repeated except that the final composition included an additional 4.4% by weight of the levo form of tartaric acid. The cleaning results obtained with this composition were similar to the results obtained in Example 1. For example, substantially no additional smut removal was obtained during the washing step. Thus, it surprisingly appears that the racemic form of tartaric acid is more effective that the levo form in the present invention.

In both Example 1 and 2, heating the compositions had substantially no effect on the aluminum cleaning results.

EXAMPLES 3 TO 14

A series of compositions were prepared by blending together various components. Each of these compositions included the following:

| | Wt, gms. |
|---|---|
| Water | 300 |
| Sulfuric Acid (25% by weight in water) | 1.5 |
| Surfactant V[6] | 0.8 |
| Surfactant I | 0.3 |
| Surfactant III | 0.1 |
| Butyl carbitol (coupling agent) | 0.3 |

[6]Similar to Surfactant II.

Additional components were included in the various compositions, as indicated below. Each of these compositions was used as an aluminum beverage can cleaner as outlined in Example 1.

| Example[7] | Additional Component, gms., (Wt %) | Comments on Cleaning Test |
|---|---|---|
| 3 | Formic acid 1.2 gms. (0.4%) | No effective cleaning |
| 4 | Acetic acid 1.7 gms. (0.6%) | No effective cleaning. |
| 5 | Sulfuric acid (25% by weight in water) 25 gms. (7.6%) | Cleaning did not work well. |
| 6 | Surfactant IV 3 gms. (1.0%) | Cleaning did not work well. |
| 7 | Sulfuric acid (25% by weight in water) 25 gms. (7.6%) plus Surfactant IV 3 gms (0.9%) | Cleaning worked well. Potential for harmful aluminum etching was present because of relatively high concentration of $H_2SO_4$. |
| 8 | Propionic acid 10 gms. (3.2%) | No effective cleaning |
| 9 | Butyric acid 10 gms. (3.2%) | Not all butyric acid soluble, substantial cleaning observed. |
| 10 | Crotonic acid 10 gms. (3.2%) | Only 3 gms. of crotonic acid soluble, no effective cleaning |
| 11 | Hydroxy acetic acid 10 gms. (3.2%) | Does not form clear solution, no effective cleaning. |
| 12 | Sodium ethylene diamine tetra acetate 10 gms. (3.2%) | Not soluble in composition, did attack smut when crystals dissolved during rinsing. |
| 13 | Ascorbic acid 10 gms. (3.2%) | Substantial cleaning observed, not as effective as with cream of tartar composition. |
| 14 | Citric acid 10 gms. (3.2%) | No effective cleaning |

[7]As a base line, the composition described above, with no additional components, was tested as an aluminum beverage can cleaner. No effective cleaning was observed.

These results indicate that various other additive materials do not provide the combination of benefits, e.g., effective aluminum cleaning with little or no risk of aluminum damage, achieved by the present composition and method. Further, it should be noted that a cleaning composition which precipitates one of its components can be detrimental to the high speed cleaning operations often used in producing aluminum articles, e.g., beverage cans.

EXAMPLES 15 TO 18

The following composition, Example 15, was prepared by blending together the following components:

| | Wt., gms. |
|---|---|
| Water | — |
| Sulfuric acid (25% by weight in water) | 37 |
| Cream of Tartar | 20 |
| Surfactant V | 1.1 |
| Surfactant I | 0.4 |
| Surfactant III | 0.1 |
| Surfactant IV | 2 |
| Butyl cellosolve | 5 |
| Isopropyl alcohol | 5 |
| Commercially available defoaming agent | 0.03 |

In Example 16, a composition as set forth above was similarly prepared except that the Surfactant IV was replaced by a commercially available blend of anionic surfactants (Surfactant VI) which included ammonium lauryl sulfate; lauramide diethanol amine; sodium lauroyl sarcosinate; and isostearamide propyl ethyl diammonium ethosulfate.

In Example 17, a composition as set forth in Example 15 was similarly prepared except that 4 gms. of a commercially available mixture of water, dodecyl benzene sulfonic acid (anionic) and paraffinic mineral oil (Surfactant VII) was included.

In Example 18, a composition as set forth in Example 15 was similarly prepared except that 4 gms. of a commercially available anionic material including sodium linear alkyl sulfonate (Surfactant VIII) was included.

Each of the above-noted compositions was tested as an aluminum beverage can cleaner as outlined in Example 1. Results of these tests are summarized as follows:

| Example | Comments on Cleaning Test |
|---|---|
| 15 | This composition provided effective cleaning. Without the water component, the formula is an unstable emulsion and therefore may present handling problems. |
| 16 | This composition provided effective cleaning. The dispersed smut in the composition (after washing) precipitated out of the composition. |
| 17 | This composition provided a very clean can. Without the water component, Surfactant VII was not stable, i.e., did not from a homogenous mixture with the other components. |
| 18 | This composition did not clean as effectively as did the composition of Example 17. Thus, the paraffinic mineral oil may play a role in smut removal. |

EXAMPLES 19 TO 22

A base composition was prepared by blending together the various components with stirring:

| | Wt., Gms. |
|---|---|
| Sulfuric acid (25% by | 91 |

-continued

| | Wt., Gms. |
|---|---|
| weight in water) | |
| Cream of Tartar | 49 |
| Surfactant VIII | 4 |
| Surfactant IV | 3 |
| Commercially available defoaming agent | 0.3 |

In addition, a series of four (4) other surfactants were included, one in each of four (4) samples of the above-noted composition. These other surfactants were included in an attempt to produce a stable or clear concentrate which provided effective aluminum cleaning.

In Example 19, a commercially available material including sodium n-hexadecyl diphenyloxide disulfonate (Surfactant IX) was used. In Example 20, a commercially available material including octyl phenoxy polyethoxy ethanol (Surfactant X) was used. In Example 21, a commercially available material including nonyl phenoxy poly (ethyleneoxy) ethanol (Surfactant XI) was used. In Example 22, a commercially available material including aliphatic polyalkoxylates (Surfactant XII) was used.

Each of these concentrates was allowed to stand quiet for a period of time and then observed. Results of these observations are summarized as follows:

| Example | Observations |
|---|---|
| 19 | This concentrate was clear. However, when it was combined with additional water and used to clean aluminum beverage cans, as set for in Example 1, its cleaning performance was poor relative to other compositions derived from cream of tartar. |
| 20 | Concentrate was cloudy and separated. |
| 21 | Concentrate was very cloudy. |
| 22 | Concentrate was cloudy and separated. |

These results indicate that if all the components, other than a substantial portion of the water, are to be included in a single mixture it may be important to effectively stir the concentrate before combining it with water for aluminum cleaning. In addition, these results also indicate that if a clear composition is deemed necessary, e.g. for marketing purposes, it may be necessary to provide the concentrated form of the present composition as two or more concentrates.

EXAMPLE 23

Two separate concentrates were prepared blending together the following components:

| | Wt % |
|---|---|
| Concentrate A | |
| Cream of tartar | 35.3 |
| Sulfuric acid (25% by weight in water) | 64.7 |
| Density 1.39 gms/ml. | |
| Concentrate B | |
| Surfactant VII | 72 |
| Surfactant IV | 20 |
| Commercially available defoaming agent | 1 |
| Density 0.93 gms/ml | |

Each of these concentrates was substantially clear. A cleaning composition was prepared by combining Concentrate A, at a rate of 9 fluid oz. per gallon, and Concentrate B, at a rate of 1.2 fluid oz. per gallon, with water. The resulting clear composition was tested as an aluminum beverage can cleaner as set forth in Example 1. All of the smut was removed from the can, and no foaming problems were encountered.

These results demonstrate one alternative to using a single non-homogeneous concentrate. Thus, the cleaner can be manufactured as two, or more, substantially clear (homogeneous) concentrates, which are then shipped to the cleaning site, combined with water and made ready for use as an aluminum cleaner.

While this invention has been described with respect to various specific examples and embodiments, it is to be understood that the invention is not limited thereto and that it can be variously practiced within the scope of the following claims.

What is claimed is:

1. A process for cleaning debris from the surface of an aluminum-containing article comprising:

contacting a debris-laden aluminum-containing article with a composition at conditions effective to do at least one of the following: (1) remove at least a portion of said debris from said aluminum-containing article and (2) condition at least a portion of said debris for removal from said aluminum-containing article, said composition comprising water, at least one tartaric component selected from the group consisting of racemic tartaric acid, salts of racemic tartaric acid and mixtures thereof in an amount effective to at least facilitate at least one of said removal of said debris and said conditioning of said debris, at least one acidic component in an amount effective to increase the solubility of said tartaric component in said composition, and at least one surface active component in an amount effective to enhance at least one of said removal of said debris and said conditioning of said debris, said contacting occurring substantially without etching said aluminum-containing article; and recovering said aluminum-containing article having at least a portion of said debris removed therefrom.

2. The process of claim 1 wherein said recovery step includes removing debris from said aluminum-containing article.

3. The process of claim 1 wherein said composition comprises a major amount by weight of water.

4. The process of claim 1 wherein said acidic component is a stronger acid than said racemic tartaric acid.

5. The process of claim 1 wherein said acidic component is selected from the group consisting of sulfuric acid, phosphoric acid, hydrochloric acid, hydrofluoric acid, nitric acid and mixtures thereof.

6. The process of claim 1 wherein said acidic component is selected from the group consisting of sulfuric acid, phosphoric acid and mixtures thereof.

7. The process of claim 1 wherein said surface active component is selected from the group consisting of nonionic surfactants, anionic surfactants and mixtures thereof.

8. The process of claim 1 wherein said surface active component is selected from the group consisting of anionic surfactants and mixtures thereof.

9. The process of claim 1 wherein said composition further comprises a minor amount of at least one substantially hydrocarbonaceous material.

10. The process of claim 1 wherein said debris is a combination of inorganic and organic material.

11. The process of claim 1 wherein said debris is included on said aluminum-containing article as a result of the forming of said aluminum-containing article.

12. The process of claim 11 wherein said aluminum-containing article is a beverage or foodstuff container and said forming includes a metal drawing step.

13. The process of claim 1 wherein said debris comprises smut.

14. The process of claim 12 wherein said debris is smut.

15. A process for cleaning debris from the surface of an aluminum-containing article comprising:

contacting a debris-laden aluminum-containing article with a composition at conditions effective to do at least one of the following: (1) remove at least a portion of said debris from said aluminum-containing article and (2) condition at least a portion of said debris for removal from said aluminum-containing article, said composition comprising water, at least one tartaric component selected from the group consulting of tartaric acid other than pure levo tartaric acid, salts of tartaric acid other than pure levo tartaric acid and mixtures thereof in an amount effective to at least facilitate at least one of said removal of said debris and said conditioning of said debris, at least one acidic component in an amount effective to increase the solubility of said tartaric component in said composition, and at beast one surface active component in an amount evocative to enhance at least one of said removal of said debris and said conditioning of said debris, said contacting occurring substantially without etching said aluminum-containing article; and recovering said aluminum-containing article having at least a portion of said debris removed therefrom.

16. The process of claim 15 wherein said recovering step includes removing debris from said aluminum-containing article.

17. The process of claim 15 wherein said acidic component is a stronger acid than racemic tartaric acid and is selected from the group consisting of sulfuric acid, phosphoric acid, hydrochloric acid, hydrofluoric acid, nitric acid and mixtures thereof.

18. The process of claim 15 wherein said acidic component is selected from the group consisting of sulfuric acid, phosphoric acid and mixtures thereof.

19. The process of claim 15 wherein said debris is included on said aluminum-containing article as a result of the forming of said aluminum-containing article.

20. The process of claim 19 wherein said aluminum-containing article is a beverage or foodstuff container and said forming includes a metal drawing step.

21. The process of claim 15 wherein said debris comprises smut.

* * * * *

UNITED STATES PATENT AND TRADEMARK OFFICE

CERTIFICATE OF CORRECTION

PATENT NO. : 4,940,493

DATED : July 10, 1990

INVENTOR(S) : Fred Neidiffer et al

It is certified that error appears in the above-identified patent and that said Letters Patent is hereby corrected as shown below:

Column 6, line 30 change "(5)" to -- (4) --.
Column 10 lines 65-66 delete "substantially".
Column 11, line 21 change "consulting" to -- consisting --.
Column 12, line 1 change "beast" to -- least --.
Column 12, line 2 change "evocative" to -- effective --.

Signed and Sealed this

Twenty-eighth Day of January, 1992

*Attest:*

HARRY F. MANBECK, JR.

*Attesting Officer*

*Commissioner of Patents and Trademarks*